US006449773B1

(12) United States Patent
Shwartz et al.

(10) Patent No.: US 6,449,773 B1
(45) **Date of Patent: *Sep. 17, 2002**

(54) HEADGEAR AND METHOD FOR EXHIBITING A DISPLAY THEREON

(75) Inventors: Kenneth Shwartz; Charles Lord, both of Mattapoisett, MA (US)

(73) Assignee: Ahead Headgear, New Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/904,053

(22) Filed: Jul. 12, 2001

(51) Int. Cl.[7] ..... A42B 1/24
(52) U.S. Cl. ..... 2/195.1; 2/209.13
(58) Field of Search ..... 2/171, 209.12, 2/209.13, 209.14, 175.1, 195.1, 195.6, 195.7; 40/329, 586, 312, 662

(56) References Cited

U.S. PATENT DOCUMENTS

D68,685 S * 11/1925 Weinrott et al. ..... 2/171
2,803,829 A * 8/1957 Tscharner ..... 2/171
5,276,985 A * 1/1994 Halloran ..... 40/329
5,410,761 A * 5/1995 Connelly et al. ..... 2/195.1
5,452,479 A * 9/1995 Mostert ..... 2/195.1
5,465,426 A * 11/1995 Beaton ..... 2/195.1
5,509,144 A * 4/1996 Soergel et al. ..... 2/195.1
6,012,176 A * 1/2000 Daley, III ..... 2/209.13
6,154,992 A * 12/2000 Lee ..... 40/329
6,240,568 B1 * 6/2001 Lee ..... 2/209.13
6,311,332 B1 * 11/2001 Lien ..... 2/209.13

* cited by examiner

*Primary Examiner*—Gloria M. Hale
(74) *Attorney, Agent, or Firm*—Foley, Hoag & Eliot, LLP

(57) ABSTRACT

A headgear and method for exhibiting displays, such as company logos, special events, messages, or just general advertisement on the bill of the headgear are provided. The bill, generally made from a stiff material, can be provided with a flexible and pliable insert to permit a display to be embroidered or sewn therethrough, while permitting the bill to maintain its shape.

21 Claims, 5 Drawing Sheets

HEADGEAR AND METHOD FOR EXHIBITING A DISPLAY THEREON

TECHNICAL FIELD

The present invention relates generally to headgear, for examples caps and visors, and more particularly to headgear having a bill which permits exhibition of displays thereon.

BACKGROUND ART

Headgear, including caps and visors, have been in use for quite some time to display company logos, special events, messages, or just general advertisements. The exhibition of these displays have mostly been on the front of the cap or visor, and in particular, in the crown area of the cap or headband area of visor adjacent the forehead of the wearer, where the fabric is sufficiently soft to permit, for instance, embroidering, sewing or attachment of the display. Displays have also been provided at the back of the cap, for example, on the adjustable headband or the crown area immediately above it, since these areas are also sufficiently soft to permit embroidering, sewing or attachment of the display. To a certain extent, some of the displays have been provided on the bill of the cap or visor. Such displays, however, have mostly been embroidered or sewn on to the soft fabric covering the bill and not to the bill itself. One reason which may have prevented the display from being sewn or embroidered directly through the bill may be because most bills, being made from hard plastic or cardboard, are too stiff to permit sewing or embroidering of displays. Many commercially available caps and visors are designed to include a bill that is sufficiently stiff to permit the bill to maintain its shape when the cap or visor is worn. Such a bill may be adequate for many purposes and may be desirable in many situations. However, a stiff bill typically does not permit a display to be easily attached or embroidered therethrough.

The exhibition of displays on the bill of the headgear may also be an expensive procedure. In particular, as the fabric around the stiff bill has already been stretched tightly over the bill, manufactures cannot use the existing headgear in their warehouses, as is, to embroider the display onto the fabric around the bill. Instead, in one practice, the entire bill or the fabric over the entire bill must be removed, the display embroidered on to a new piece of fabric, and subsequently the bill be re-covered with the newly embroidered fabric. This process can be avoided if the headgear manufacturers is given sufficient notice. With notice, the manufacturers can modify the manufacturing process to accommodate the embroidering of the display onto the piece of fabric prior to covering the bill. Such modification of the hat making process, however, may require the fabric around the bill to be set aside for the embroidering, which again can be time consuming and may add unwanted expenses to the production of the headgear. As is more often than not, the amount of the order may not justify modification of the normal headgear manufacturing process. Accordingly, for those organizations wishing to have their logos, messages, or special events exhibited on the bill, unless the they can foresee a sufficient return on the sales of the headgear with such displays, many will forego the exhibition of the display on the bill of the headgear.

SUMMARY OF THE INVENTION

The present invention, in accordance with one embodiment, provides a headgear, for example, a visor or a cap which can exhibit displays, such as company logos, special events, messages, or just general advertisements.

The headgear, as provided, can include a band for placement circumferentially about a head of a person. The headgear can also include a bill portion having distal end and a proximal end, which proximal end is attached to the band. The bill, in an embodiment of the invention, includes an insert made from a material that is sufficiently soft and flexible. By providing an insert of soft, flexible material, the bill is provided with an area that is sufficiently pliable to permit a display to be sewn, embroidered, or attached therethrough, while permitting the remainder of the bill to maintain its shape. The headgear may also include a crown portion defining a hat for placement on to the head of a person. The crown portion is preferably provided with a lower substantially circular periphery to which the band may be attached. As the head size may vary from person to person, the headgear of the present invention may include a band which permits adjustment of its circumference, so as to accommodate different size heads.

In accordance with another embodiment of the present invention, a method of exhibiting a display on a headgear is provided. The method may included providing a headgear having a headband and a bill portion that is attached at its proximal end to the headband. The bill portion, in one embodiment, includes an insert made from a soft flexible material. Subsequently, a display may be secured through the flexible insert on to the bill portion of the headgear either by embroidering, sewing or attaching, for instance, with a pin. Alternatively, only the bill portion of the headgear having the flexible insert is initially provided, to which the display is embroidered or sewn through the flexible insert. Thereafter, the bill portion is attached at its proximal end to the band. In either of these embodiments, a crown portion defining a hat and having a lower periphery may be provided for attachment to the band along the periphery.

In a further embodiment for exhibiting a display on a headgear, a headgear is provided with a crown portion and a bill portion attached at its proximal end to the crown portion. The bill portion, in one embodiment, includes an insert made from a soft flexible material. Subsequently, a display may be secured through the flexible insert on to the bill portion of the headgear either by embroidering, sewing or attaching with, for instance, a pin. In an alternate embodiment, only the bill portion of the headgear having the flexible insert is initially provided, to which the display is embroidered or sewn through the insert. Thereafter, the bill portion is attached at its proximal end to the crown portion.

DETAILED DESCRIPTION OF SPECIFIC EMBODIMENTS

The present invention provides, in one embodiment, a headgear which permits embroidering or sewing of displays, such as company logos, special events, messages, or just general advertisement, thereon. The headgear of the present invention may either be a visor or a cap.

Figure 1A:
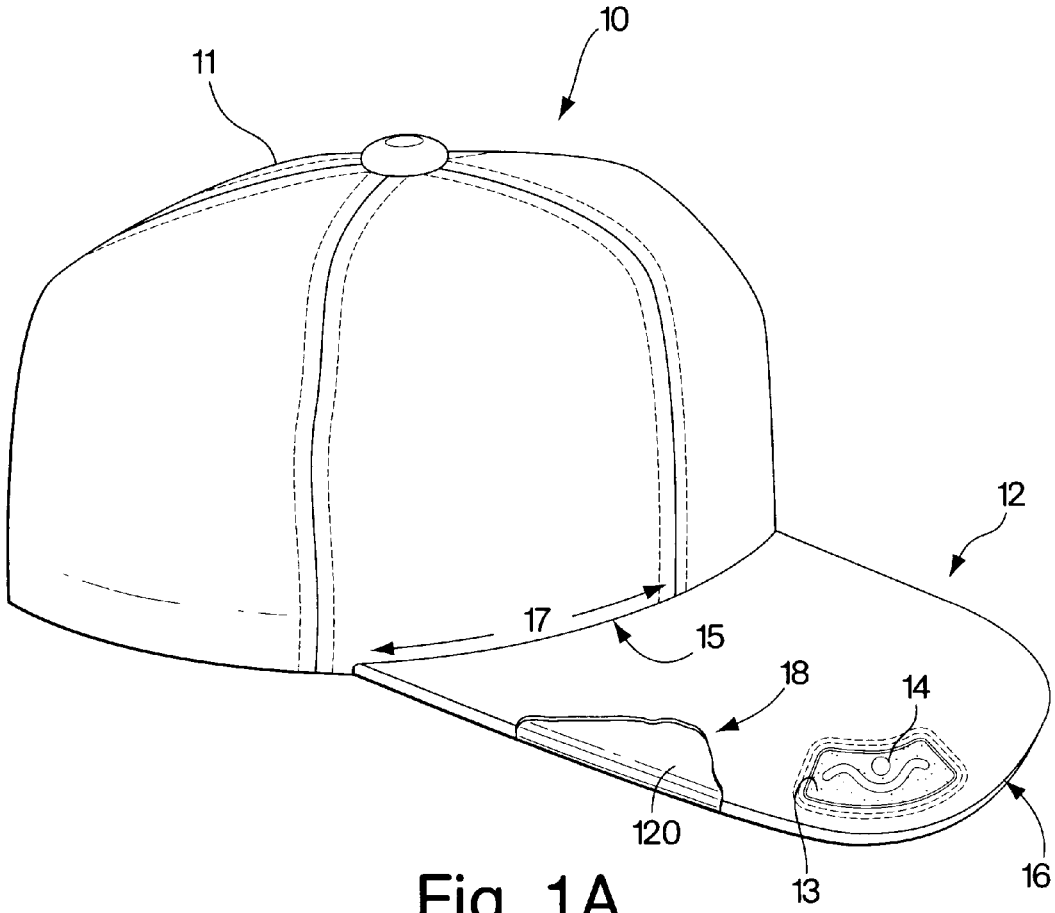
FIG. 1A illustrates a perspective upper frontal view a headgear in accordance with one embodiment of the present invention.
Figure 1B:
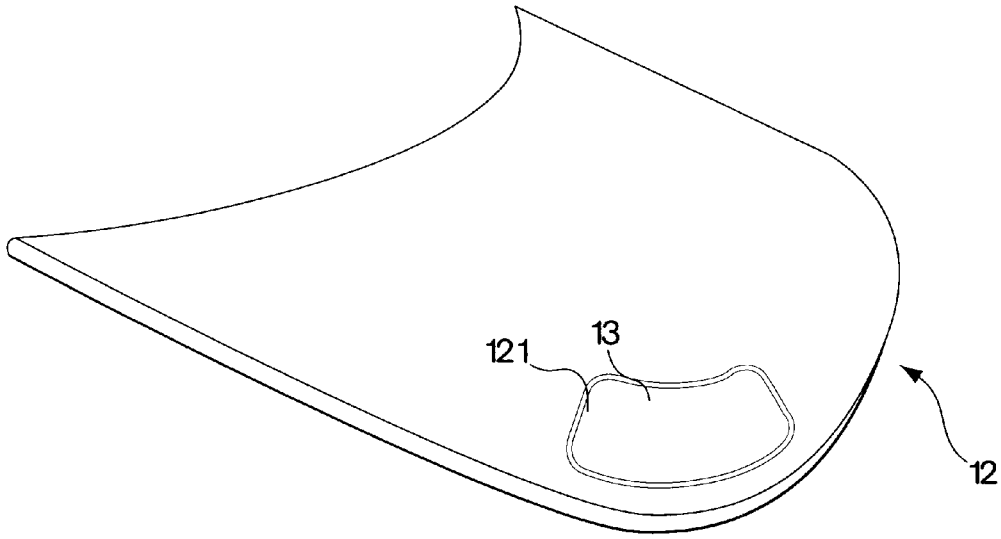
FIG. 1B illustrates a bill portion of the headgear shown in FIG. 1A, which bill portion includes an insert therein.

In FIGS. 1A–B there is shown a cap 10 having a crown portion 11 and a bill portion 12 attached thereto. The crown portion 11, in general, may be used for placement on to a head of a person. The bill portion 12, on the other hand, may be characterized by a substantially stiff material, such as hard plastic or cardboard, with a soft, flexible insert 13 therein. The provision of a soft, flexible insert 13 in the bill portion 12 permits a display 14 to be sewn, embroidered or attached, for example, with a pin, through the flexible insert 13, while permitting the bill portion 12 to adequately maintain its shape. To position the flexible insert 13 within the bill portion 12, in one embodiment, an aperture 121 may be provided, for instance, by die-cutting, at a predetermined location on the bill portion 12 with a shape that complements the shape of the insert 13. In this manner, insert may adequately fit within the aperture 121 and extends from an upper surface to a lower surface of the bill portion 12. It should be appreciated that the insert 13 and aperture 121 may be located anywhere on the bill portion 12, and may be designed to have any geometric shape, so long as the two complement one another for adequate fitting, such that a sufficiently soft and flexible section on the bill portion 12 may be provided for embroidering or sewing therethrough.

The flexible insert 13 may be maintained within the aperture 121 by any conventional means. In an embodiment, edges around insert 13 and aperture 121 may be sewn together using conventional threading. Alternatively, the edges of insert 13 may be glued to the edges of aperture 121. In addition, as it may be desirable to minimize the appearance of a transition from the flexible insert 13 to the stiff bill portion 12 in finished cap 10, the insert 13 and the aperture 121 may be provided with complementary non-linear edges, e.g., undulating or zig-zagging patterns.

The bill portion 12, as shown in FIG. 1, includes a proximal end 15 and a distal end 16. The proximal end 15 may be designed to have a curvature 17 which complements the curvature about the periphery of the crown portion 11, so that the bill portion 12 may be closely attached at its proximal end 15 to the crown portion 11. It should be appreciated that the curvature 17 may vary according to the size of the crown portion 11, and in particular, the circumference of the crown portion 11, so long as the curvature 17 is maintained in a manner which permits a complementary fit about the periphery of the crown portion 11.

The bill portion 12, in one embodiment, is preferably overlaid with a piece of covering 18. To provide the covering 18 with a secure fit over the bill portion 12, the covering 18 may be sewn directly on to the bill portion 12. Alternatively, the covering 18 may be tightly stretched over the bill portion, and the covering 18 and bill portion 12 sewn to the crown portion 11. If desired, the covering 18 may be of the same material and color from which the crown 11 is made. Otherwise, the covering 18 may be of a different material and color from which the crown 11 is made. In an embodiment, the material from which the covering 18 may be made includes cotton fabric, polyester fabric, plastic, or other commercially available material typically used in the manufacturing of headgear or clothes.

In order to provide the insert 13 with characteristics which permit a display 14 to be sewn, embroidered or attached therethrough, the material from which the flexible insert 13 may be made is provided with a range of density, so long as the flexible insert 13 maintains a shape similar to that of the bill portion 12. In addition, depending on the thickness of the bill portion 12, the insert 13 may vary in thickness according to the thickness of the bill portion 12. Materials from which the inserts 13 may be made includes closed cell foam, such as, neoprene or polyolefin resin substance.

Figure 2:
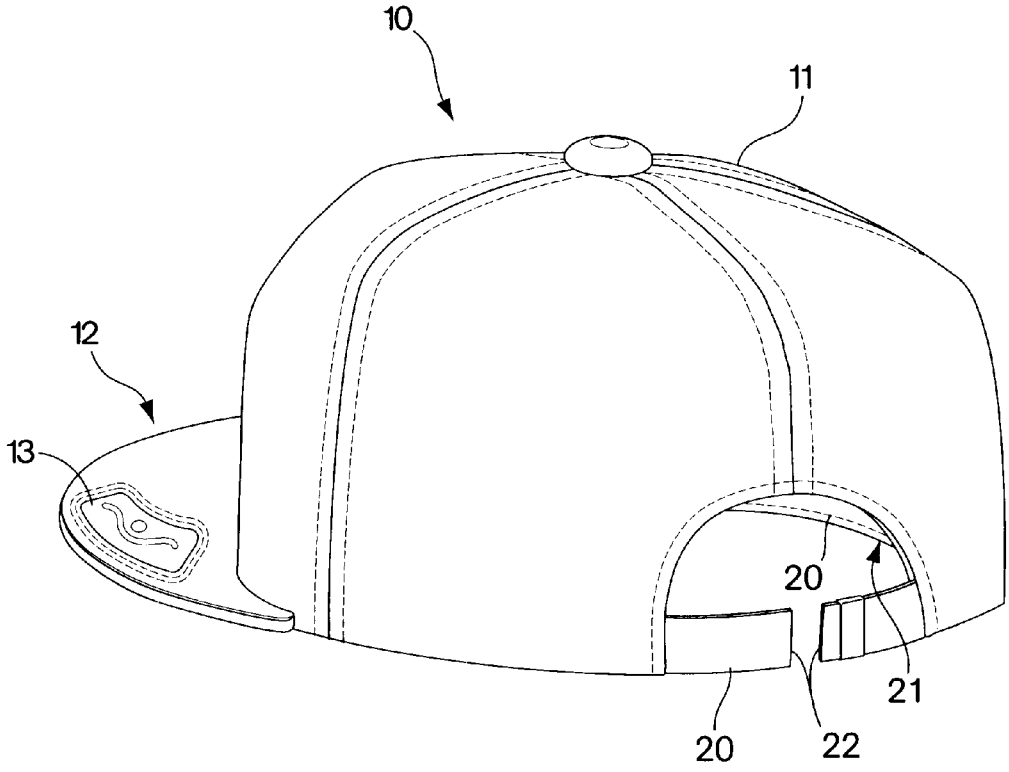
FIG. 2 illustrates a perspective upper rear view of the headgear in FIG. 1.

Referring now to FIG. 2, the cap 10 may also include a band 20, secured to the crown portion 11, and designed for placement circumferentially about a head of a person (not shown). To allow attachment of the band 20 to the crown portion 11, in the embodiment shown in FIG. 2, the crown portion 11 may include a lower periphery 21 against which the band 20 may be secured. The band 20 may include opposing ends 22 designed to engage one another. By providing the band 20 with opposing ends 22, different size heads may be accommodated when the ends 22 are adjusted relative to one another. Engagement of the opposing ends 22 may be accomplished by any conventional fasteners known in the art. Examples of fasteners include those that have plastic rivets on one end and complementary holes on the other, hooks on one end and loops on the other, and a lead on one end and a clip on the other. It should be noted that although a band 20 is provided, the cap 10 of the present invention does not necessarily require a band in such a manner. Instead, an elastic loop, or a draw string along the lower periphery 21 of the crown 11 may be used to accommodate different head sizes.

Figure 3A:
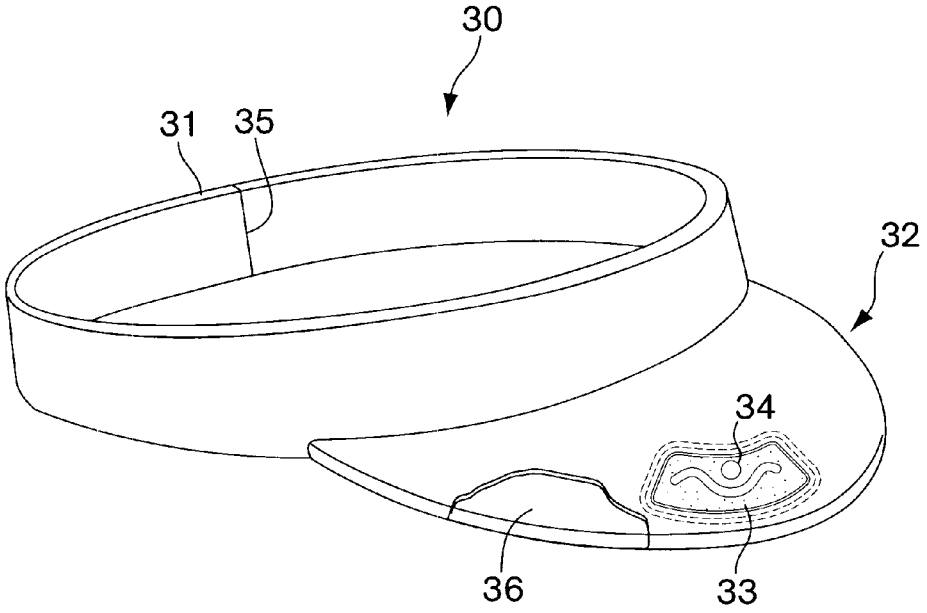
FIG. 3A illustrates an alternate embodiment of a headgear of the present invention.

In FIG. 3, there is shown a visor 30, an alternate embodiment of the headgear of the present invention, which includes a band 31 and a bill portion 32 attached to the band 31. Attachment of the bill portion 32 to the band 31 may be accomplished by means known in the art, including sewing of a covering 36 over the bill portion 32 directly to the band 31. It should be appreciated that the band 31 and bill portion 32 of visor 30 are substantially similar to the band 20 and bill portion 12 of the cap 10 shown in FIGS. 1 and 2. In particular, the band 31 includes opposing ends 35, which when adjusted relative to one another, vary the circumference of the band 31 to permit accommodation of different head sizes. Engagement of the ends of the band 31 may be accomplished with fasteners similar to those described in connection with the band 20 of cap 10. In one embodiment, the band 31 may include a covering 36 similar in pattern and color to that provided on the bill portion 32. In this manner, the bill portion 32 and band 31 may match for aesthetic purposes. Of course the coverings on the band 32 and 32 may have different patterns and colors if so desired.

Figure 3B:
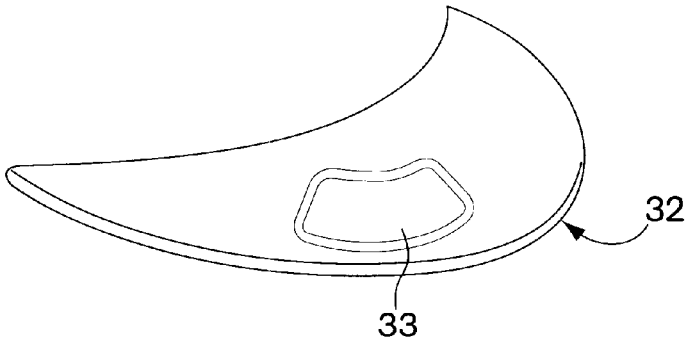
FIG. 3B illustrates a bill portion of the headgear shown in FIG. 3A, which bill portion includes an insert therein.

The bill portion 32, as shown in FIG. 3B, may include a soft, flexible insert 33 having characteristics similar to that of the flexible insert 13 in the cap 10. Specifically, the flexible insert 33 is preferably sufficiently pliable to allow a display 34 to be sewn, embroidered or attached therethrough, while the remainder of the bill portion 32, made from a stiff material, acts to adequately maintain the shape of the bill. To this end, the flexible material 13 may be provided with any density and thickness sufficient to accomplish the intended purposes. Materials which can exhibit these characteristics may be made generally from closed cell foam, for example, neoprene or polyolefin resin substance.

The exhibition of a display on the bill of the headgear will now be discussed in accordance with one embodiment of the present invention. Although reference is hereinafter made to the cap 10, it should be understood that the discussion is similarly applicable to the visor 30. To exhibit a display 40, such as that shown in FIG. 4, by embroidering, the location of the flexible insert 13 on the bill portion 12 is determined. Subsequently, the bill portion 12, and a machine (not shown) for embroidering the display 40 are engaged at the insert 13.

The machine is thereafter initiated to permit embroidering needle 41 to penetrate through the insert 13 along with threading 42. The machine is permitted to continue until the desired display 40 is completed.

Figure 5:
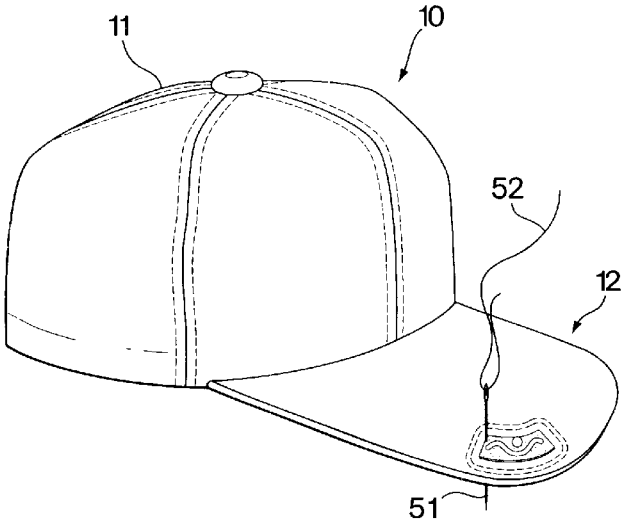

To exhibit the display 40, for example, by sewing, the display 40, as shown in FIG. 5, may initially be placed directly on the area of the flexible insert 13 on the bill portion 12. Subsequently, engagement between the display 40, as it is positioned on flexible insert 13, and a machine (not shown) for securely attaching the display 40 to the bill portion 12 is initiated. The machine is thereafter activated to permit sewing needle 51 to penetrate through the flexible insert 13 along with threading 52. The machine is permitted to continue until the display 40 is securely attached through the bill portion 12.

Figure 6:
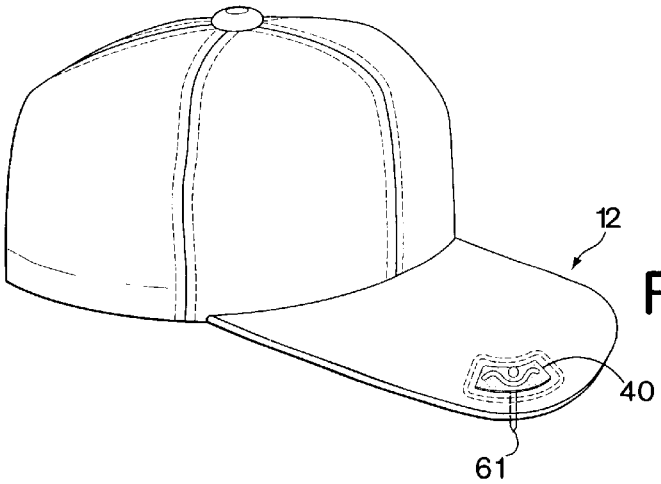
Figure 7:
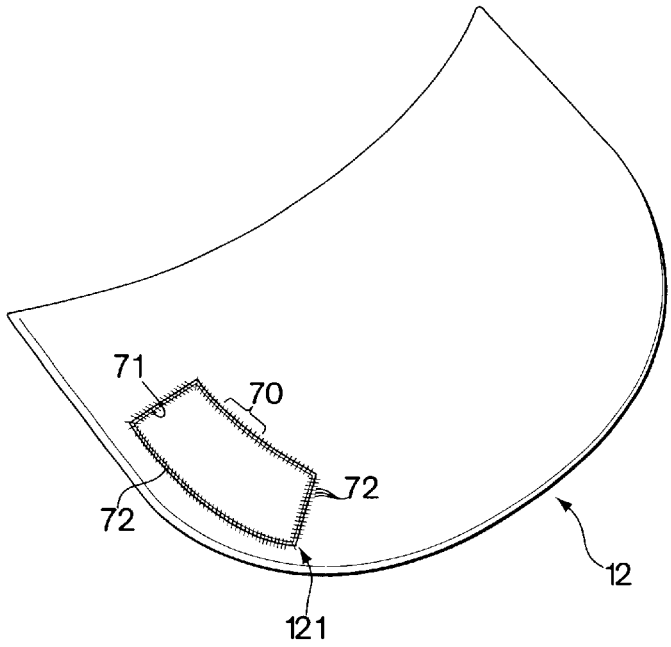
Figure 8:
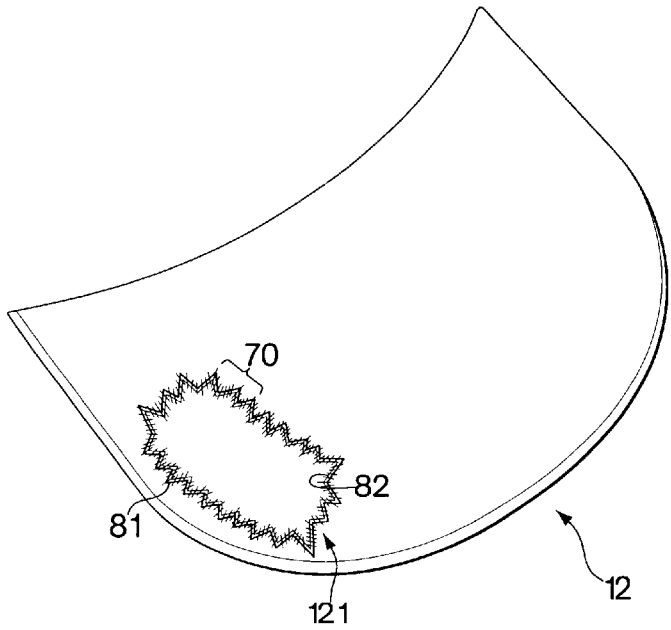

To exhibit display 40 by attachment, in the instance wherein the display 40 is, for example, a pin, as illustrated in FIG. 6, pin 61 on display 40 may be pushed directly across the soft flexible insert 13 to extend to an underside of the bill portion 12. Subsequently, the display 40 may be secured to the insert 13 by positioning, in one embodiment, a clip (not shown) onto pin 61.

Figure 4:
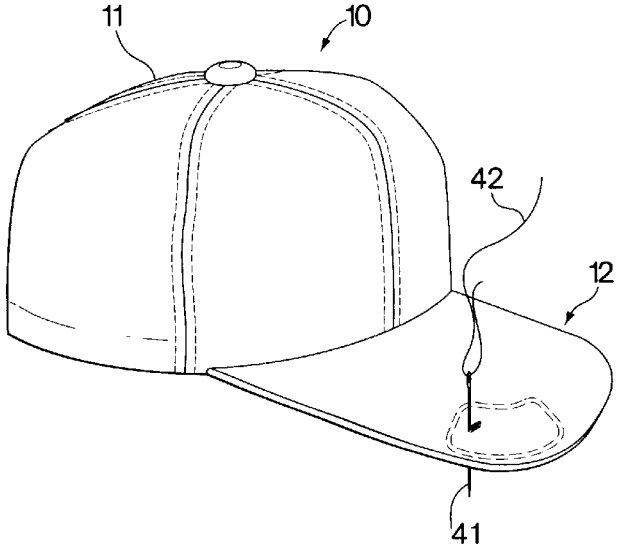
FIGS. 4–8 illustrate various embodiments for securely exhibiting a display on to the headgear of the present invention.

It should be appreciated that the processes provided in connection with FIGS. 4 and 5 may be modified, so that the securing of the display 40 may be accomplished during the hat manufacturing process. Specifically, the embroidering or sewing of the display 40 through the bill portion 12 may be accomplished prior to the attachment of the bill portion 12, at its proximal end, to the crown 11 of the cap 10 or band 32 of the visor 30. In this manner, the present invention also contemplates that a plurality bill portions 12, each exhibiting a different display 40, may be provided for a headgear designed with a removable bill portion 12, such that depending on the mood of the wearer or the occasion encountered, the bill portion 12 with one display 40 may be interchanged with another bill portion 12 having another display 40, so as to exhibit different displays that are appropriate for the specific occasions. The headgear having a removable bill may include any means known in the art, for example, hook and loop fasteners, for removable attachment of the bill to the headgear.

While the invention has been described in connection with the specific embodiments thereof, it will be understood that it is capable of further modification. Furthermore, this application is intended to cover any variations, uses, or adaptations of the invention, including such departures from the present disclosure as come within known or customary practice in the art to which the invention pertains, and as fall within the scope of the appended claims.

What is claimed is:

1. A headgear for exhibiting a display, the headgear comprising:

a crown portion for placement on to a head of a person;

a bill portion being attached at its proximal end to the crown portion and having an upper surface and a lower surface; and an insert positioned within the bill portion and extending from the upper surface to the lower surface of the bill portion, the insert being made from a flexible material to permit a display to be secured thereon.

2. A headgear as set forth in claim 1, wherein the flexible material has a density and thickness sufficient to permit securing of display thereon.

3. A headgear as set forth in claim 1, wherein the flexible material from which the bill is made is closed cell foam.

4. A headgear as set forth in claim 3, wherein the closed cell foam is one of neoprene and polyolefin resin material.

5. A headgear as set forth in claim 1, further including an adjustable band attached to a lower portion of the crown to accommodate different size heads.

6. A headgear for exhibiting a display, the headgear comprising:

a band for placement circumferentially about a head of a person;

a bill portion being attached at its proximal end to the band and having an upper surface and a lower surface; and an insert positioned within the bill portion and extending from the upper surface to the lower surface of the bill portion, the insert being made from a flexible material to permit a display to be secured thereon.

7. A headgear as set forth in claim 6, wherein the flexible material has a density and thickness sufficient to permit securing of display thereon.

8. A headgear as set forth in claim 6, wherein the flexible material from which the bill is made is closed cell foam.

9. A headgear as set forth in claim 8, wherein the closed cell foam is one of neoprene and polyolefin resin material.

10. A headgear as set forth in claim 6, wherein the band is an adjustable band to permit adjustment of its circumference so as to accommodate different size heads.

11. A method for exhibiting a display on a headgear, the method comprising:

providing a headgear having a crown portion for placement on to a head of a person, a bill portion being attached at its proximal end to the crown portion, and an insert extending from an upper surface to the lower surface of the bill portion, the insert made from a flexible material sufficiently pliable to permit a display to be secured thereon; and securing a display through the flexible insert.

12. A method as set forth in claim 11, wherein the step of securing includes embroidering the display.

13. A method as set forth in claim 11, wherein the step of securing includes:

placing a display directly on to the flexible insert; and sewing the display through the flexible insert.

14. A method as set forth in claim 11, wherein the step of securing includes:

placing a display having a pin thereon; and pushing the pin through the flexible insert.

15. A method of exhibiting a display on a headgear, the method comprising:

providing a headgear having a headband, a bill portion being attached at its proximal end to the headband, and an insert extending from an upper surface to the lower surface of the bill portion, the insert made from a flexible material sufficiently pliable to permit a display to be secured thereon; and securing a display through the flexible insert.

16. A method as set forth in claim 15, wherein the step of securing includes embroidering the display.

17. A method as set forth in claim 15, wherein the step of securing includes:

placing a display directly on to the flexible insert; and sewing the display through the flexible insert.

18. A method as set forth in claim 15, wherein the step of securing includes:

placing a display having a pin thereon; and pushing the pin through the flexible insert.

19. A method of exhibiting a display on a headgear, the method comprising:

providing a bill portion of a headgear, the bill portion having an upper surface, a lower surface and an insert extending from the upper surface to the lower surface of the bill portion, the insert made from a flexible material sufficiently pliable to permit a display to be secured thereon;

securing a display through the flexible insert;

providing a band for placement circumferentially about a head of a person; and attaching the bill portion at its proximal end to the band.

20. A method of exhibiting a display on a headgear, the method comprising:

providing a bill portion of a headgear, the bill portion having an upper surface, a lower surface and an insert extending from the upper surface to the lower surface of the bill portion, the insert made from a flexible material sufficiently pliable to permit a display to be secured thereon;

securing a display through the flexible insert;

providing a crown portion for placement on to the head of the person; and attaching the bill portion at its proximal end to the crown portion.

21. A method for manufacturing a headgear for exhibiting a display, the method comprising:

providing an insert made from a flexible material sufficiently pliable to permit a display to be secured thereon;

cutting through a bill portion of the headgear so as to generate an aperture extending from an upper surface to a lower surface of the bill portion and having a shape to complementarily receive the insert therein;

securing the insert within the aperture, such that the insert extends from the upper surface to the lower surface of the bill portion.

* * * * *